US006345890B2

(12) United States Patent
Tsukuni

(10) Patent No.: US 6,345,890 B2
(45) Date of Patent: Feb. 12, 2002

(54) INK CARTRIDGE AND INK JET PRINTER

(75) Inventor: Hiroyuki Tsukuni, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/805,927

(22) Filed: Mar. 15, 2001

(30) Foreign Application Priority Data

Mar. 16, 2000 (JP) ..... 12-073298

(51) Int. Cl.[7] ..... B41J 2/175
(52) U.S. Cl. ..... 347/86
(58) Field of Search ..... 347/85, 86, 87, 347/49; 206/701, 722, 723

(56) References Cited

U.S. PATENT DOCUMENTS 5,701,995 A * 12/1997 Higuma et al. ..... 206/205

5,825,387 A * 10/1998 Cowger et al. ..... 347/86

* cited by examiner

*Primary Examiner*—Michael Nghiem
(74) *Attorney, Agent, or Firm*—McGinn&Gibb, PLLC

(57) ABSTRACT

An ink cartridge includes: an ink container; a vent provided in the ink container; and an ink supply hole for accepting an ink supply tube for supplying a recording head with ink. When the ink cartridge is inserted into a cartridge container of a printer without removing a closing member for closing vent, an installation stopper formed in one unit with the closing member prevents the ink supply hole from being engaged with a tube container of the cartridge container so as not to accept the ink supply tube.

10 Claims, 8 Drawing Sheets

INK CARTRIDGE AND INK JET PRINTER

BACKGROUND OF THE INVENTION

1. Field of the Invention

The present invention relates to an ink jet printer and an ink cartridge which is prevented from being installed in the ink jet printer in an inappropriate state where a vent is not open.

2. Description of the Related Art

Conventionally, as shown in FIG. 7, an ink cartridge 30, which is attachable to and detachable from an ink jet printer, has a vent (hole) 33 for exposing an ink container 32 to the air and an ink supply hole 36 for providing a recording head with ink. After the ink cartridge is manufactured and before it is actually used, the vent 33 and the ink supply hole 36 are covered with sealing members, respectively. As illustrated in FIG. 7, usually, the vent 33 is sealed with a vent seal 34, which is affixed on an upper surface 35 of a casing 31 and can easily be fallen off.

When the ink cartridge 30 is installed into a cartridge holder (not illustrated) of the ink jet printer, an ink supply tube to be in contact with the recording head breaks through a sealing member 37 for sealing the ink supply hole 36 formed on the bottom section of the casing 31. The ink supply tube is engaged with a packing member which is arranged in the internal circumference of the ink supply hole 36, and enters the ink container 32. The ink container 32 and the recording head are in contact with each other through the ink supply tube.

The user of the ink jet printer needs to fall off the vent seal 34, before inserting the ink cartridge 30 into the cartridge holder. The ink container 32 is exposed to the air through the vent 33, whereby ink inside the ink container 32 is always atmospherically pressure-loaded. With the effect of this pressure and the head pressure of the ink, the ink is smoothly provided onto the recording head through the ink supply tube.

In the case where the user unintentionally leaves the vent seal 34 as it is, and the vent 33 is not exposed to the air, the pressure is not loaded into the ink container 32. Hence, only the head pressure of the ink is only the driving force for providing the ink onto the recording head. In this case, the ink supply tube can not stably provide the recording head with the ink, resulting in unstable printing. Along with the use of the ink, the negative pressure occurs inside the ink container 32. Thus, until the ink is out put from the recording head, the air is likely to penetrate into the ink container 32 in the form of bubbles. If the bubbles enter between the ink container 32 and the recording head, the ink is caused to be output intermittently. Once the bubbles enter there between, they can not easily be removed therefrom, even the vent 33 is open, causing the awkward printing.

As illustrated in FIG. 8, when the user unintentionally leaves the vent seal 34 as it is, the conventional ink cartridge 30 may apparently be installed desirably into a cartridge holder 40. Particularly, a tube container 44 for containing an ink supply tube 45 and which is formed on the bottom surface of a casing 41 is engaged with the ink supply hole 36. A lid section 42 rotates centrically about a supporting shaft 43, and a hook 42*a* of the lid section 42 can be engaged an engagement claw 41*a* of the casing 41. In this structure, the user can not be aware that the he/she has left the vent seal 34 as is, until any of the above-described problems arise.

SUMMARY OF THE INVENTION

The present invention has been made in consideration of the above. It is accordingly an object of the present invention to provide an ink jet printer and an ink cartridge which can be prevented from being inappropriately installed into the ink jet printer without opening a vent of the ink cartridge which is attachable to and detachable from the ink jet printer.

Another object thereof is to provide an ink jet printer and an ink jet cartridge which does not provide a recording head with ink, in a case where the ink cartridge is inappropriately installed into the ink jet printer without opening a vent of the ink cartridge.

In order to achieve the above objects, according to the first aspect of the present invention, there is provided an ink cartridge, which is contained in a cartridge container of a printer, comprising:

an ink container;

a vent (hole) which is provided in the ink container;

an ink supply hole for accepting an ink supply tube, being in contact with a recording head of the printer so as to supply an ink thereto;

an ink supply section which includes the ink supply hole and is engaged with a tube container, being formed in the cartridge container, containing the ink supply tube and having a concave shape;

a closing member for closing the vent, and which is removed from the ink cartridge before the ink cartridge is used; and an installation stopper which is formed in one unit with the closing member and prevents the ink supply tube from entering the ink supply hole, when the ink supply section is inserted into the cartridge container without removing the closing member.

According to the above structure, if the user inserts the ink cartridge into the cartridge container without removing the closing member for closing the vent, the ink supply section is not engaged with the tube container by the effect of the installation stopper which is formed together with the closing member in one unit. In this structure, the ink cartridge can not entirely be contained inside the cartridge container, and partially sticks out therefrom. Hence, the user can be aware that he/she has inserted the ink cartridge into the cartridge container without removing the closing member. The installation member is formed together with the closing member in one unit. Therefore, the user simply removes the installation stopper together with the closing member.

The ink supply section is not engaged with the tube container. In this structure, even if the user tries to operate the printer without knowing that he/she has not removed the closing member from the ink cartridge, no ink is supplied onto the recording head. In addition, no ink is output from the recording head, therefore, the user can simply be aware that the ink cartridge ha s inappropriately been installed.

A concave section may be formed in a circutferential section of the ink supply section; and the concave section may be engaged with a rib which is formed in a circumferential section of the tub e container, and prepared so as to settle a position of the ink supply section, thereby the ink supply section and the tube container are centered.

If the ink cartridge is installed into the cartridge container without removing the installation stopper, the concave section formed in the circumferential section of the ink supply section is interfered with the installation stopper so as not to be engaged with the ribs which are formed in the circumferential sections of the tube container. Hence, the ink cartridge is not stably positioned. Thus, the user can easily be aware of the inappropriate installation of the ink cartridge. If the user installs the ink cartridge into the cartridge container after removing the installation stopper, the concave section is engaged with the rib of the tube container. In this structure, the ink supply section and the tube container can be centered, thus securing appropriate installation of the ink cartridge.

The installation stopper and the closing member may be formed in a tape-like shape; and a thickness of the installation stopper may be larger than a thickness of the closing member.

In the case where the installation stopper is arranged on the side surface of the ink cartridge, the installation stopper can not enter the gap between the ink cartridge and the side wall of the cartridge container. Besides, the ink cartridge can not entirely be contained in side the cartridge container. Due to the structure of the tape-like shape of the installation s topper and the closing member, the ink cartridge can be handled with ease. The installation stopper which is large in thickness has a function a s a pull for pulling the closing member. Hence, the user can easily remove the installation stopper and the closing member from the ink cartridge.

The closing member may be an adhesive tape onto whose back surface which an adhesive is affixed; and the installation stopper may be adhered to an outer circumference of the ink container.

In this structure, the installation stopper can not enter the gap between the ink cartridge and the side wall of the cartridge container. Even if the user tries to insert the ink cartridge into the cartridge container by force, the installation stopper is adhered onto the side wall of the ink container. Thus, the installation stopper desirably prevents the inappropriate installation.

The closing member may be an adhesive tape onto whose back surface an adhesive is affixed; and the installation stopper may droop down and detached from an outer circumference of the ink container.

In this case, the installation stopper sticks out from the cartridge container. Then, the user can visibly recognize the sticking installation stopper, and be aware of the inappropriate installation of the ink cartridge.

The installation stopper may be formed of a material which differs from a material of the closing member. For example, the closing member covers the vent from in the upper surface of the ink container, and is formed of a soft material so as to be deformed along with the shape of the ink container. The installation stopper is formed of a rigid material.

The installation stopper may be formed of a same material as a material of the closing member.

In order to achieve the above objects, according to the second aspect of the present invention, there is provided an ink jet printer comprising:

a recording head which outputs an ink onto a recording medium;

a cartridge container which contains an ink cartridge including a vent; and an ink supply tube which is in contact with a recording head, and for supplying and ink thereonto, and wherein the ink supply tube is contained inside a tube container having a concave shape and being formed inside the cartridge container, and the tube container is engaged with an ink supply section of the ink cartridge, and the ink supply tube enters an ink supply hole included in the ink supply section so as to supply the recording head with an ink, when the ink cartridge, from which an installation stopper formed in one unit together with a closing member for covering a vent is removed, is inserted into the cartridge container.

The cartridge container may include a rotatable lid section and a body including the tube container; and when the ink cartridge without the installation stopper is inserted into the cartridge container, the lid section may rotate so as to be engaged with the body.

The cartridge container may include a rib, which is engaged with a concave section formed in a circumferential section of the ink cartridge, and which is prepared so as to settle a position of the ink supply section, thereby the tube container and the ink supply section are centered.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

An ink cartridge according to a preferred embodiment of the present invention will now be described with reference to the accompanying drawings.

Figure 1:
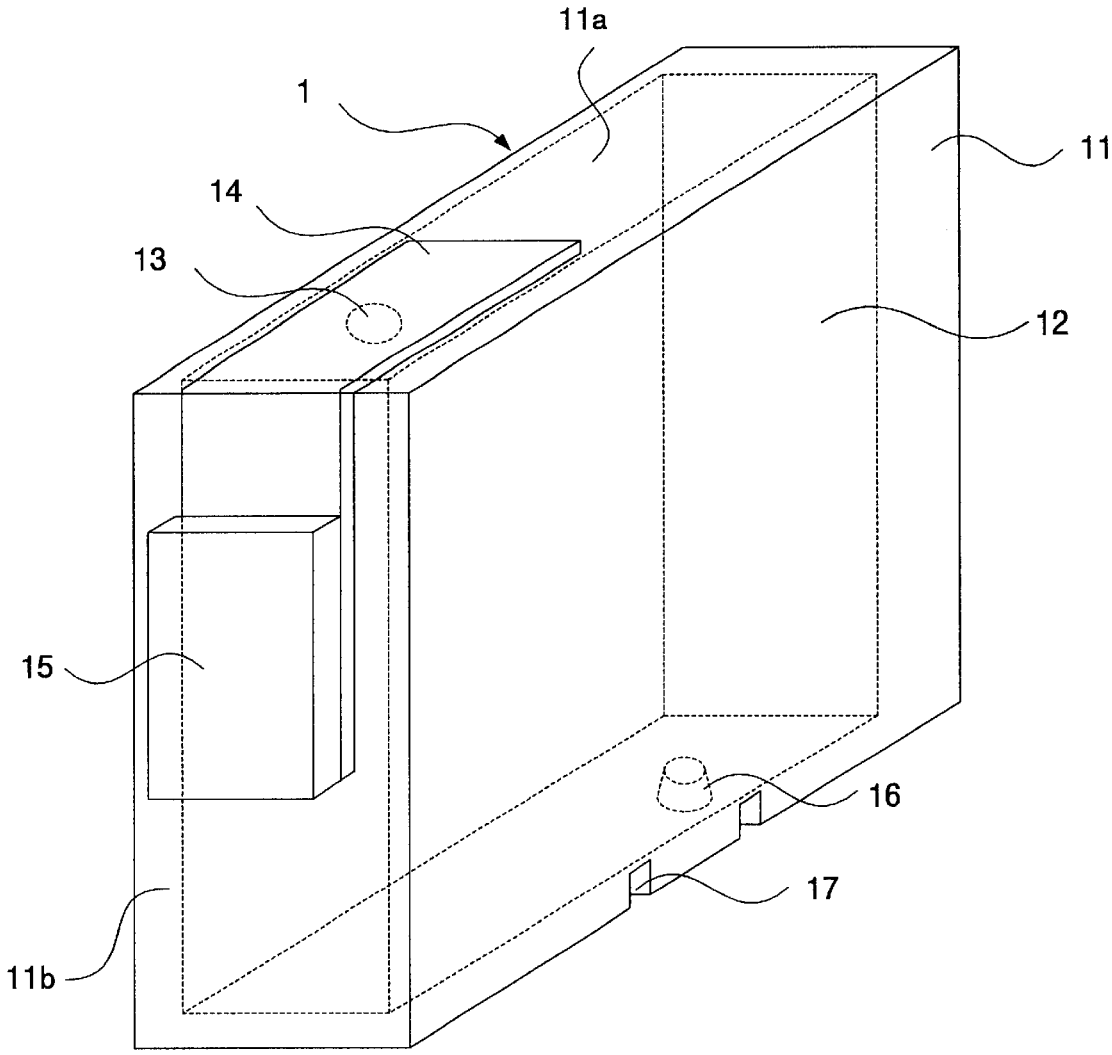
FIG. 1 is a perspective diagram showing the structure of an ink cartridge according to an embodiment of the present invention.

FIG. 1 is a perspective diagram showing the structure of the ink cartridge according to this embodiment.

An ink cartridge 1 comprises a casing 11, an ink container 12 included in the casing 11, a vent (hole) 13 which is formed on an upper surface 11*a* of the casing 11, a vent seal 14 (vent closing member) for closing the vent 13, an installation stopper 15 which is formed in a rectangular plate-like shape at one end of the vent seal 14, an ink supply section 16 which is formed on the bottom surface of the casing 11, and guide concave sections 17 which are formed around the ink supply section 16.

The vent 13 is prepared for exposing the ink container 12 to the air. The vent 13 retains a pressure level (atmospheric pressure) of ink contained inside the ink container 12, so that the ink is smoothly provided from the ink supply section 16 to a recording head 3, as will be explained later.

Figure 2:
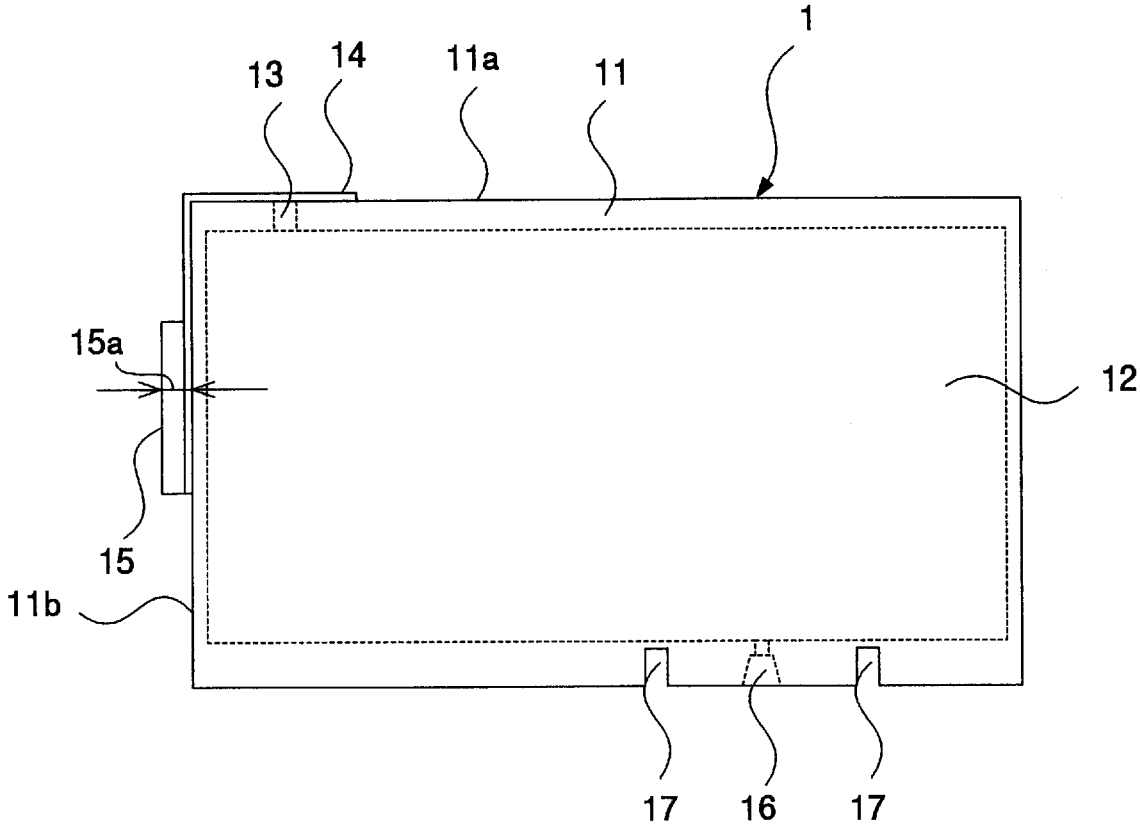
FIG. 2 is a side view of the ink cartridge of the embodiment.

As seen from FIG. 1 and FIG. 2 which is a side view of the ink cartridge 1, one end of the vent seal 14 is affixed onto the ink cartridge 1 in a circumferential position of the vent 13 so as to close the vent 3. The vent seal 14 is attached onto the ink cartridge 1 along the upper surface 11*a* to a side surface 11*b* of the casing 11. The vent seal 14 is tightly integrated with the installation stopper 15. The vent seal 14 is prepared, together with a supply section sealing film, for preventing the ink inside the ink container 12 from being leaked or vaporized, during the period of time since the shipping of the ink cartridge 1 until the actual use of the cartridge. Hence, the vent seal 14 is removed together with the installation stopper 15 from the ink cartridge 1 before the use of the ink cartridge 1, thereby to open the vent 13.

If the ink cartridge 1 is inserted into the cartridge holder 20, as will be described later, without removing the vent seal 14 and the installation stopper 15, before the cartridge 1 is used, the installation stopper 15 can not be fit into a gap between the side surface 11*b* and an internal wall, as will be explained later, of the cartridge holder 20. This interrupts the ink cartridge 1 to adequately be installed into the cartridge holder 20.

The vent seal 14 is formed entirely in a tape-like shape. The thickness of the installation stopper 15 is made larger than the thickness of the vent seal 14. The vent seal 14 is a long sealing member which is made of a soft material. An adhesive is applied onto the back surface of the vent seal 14. One end of the vent seal 14 is affixed onto the ink cartridge 1 in a circumferential position of the vent 13, and the other end thereof is adhered to the installation stopper 15. No adhesive is applied onto the back surface of the other end of the vent seal 14. Thus, the other end of the vent seal 14 is not affixed onto the side surface 11*b*.

The vent seal 14 can be formed of any material, as long as the material has adequate strength, such as a inexpensive flexible poly-vinyl material, etc. The thickness of the vent seal 14 is desirable in a range between 10 and several 100 $\mu$m, and more desirable in a range between 40 and 100 $\mu$m. In this case, when detaching the vent seal 14 from the ink cartridge 1, it is likely to change in form and not to torn off. Therefore, the vent seal 14 can be removed from the casing 11 with ease.

The installation stopper 15 is formed in such a way that a thickness 15A, including the thickness of the installation stopper 15 and the thickness of the vent seal 14, is equal to or larger the size of a gap 26 between the side surface 11*b* and the internal surface of the cartridge holder 20. The installation stopper 15 can be formed of any material, as long as the material has sufficient stiffness not to easily be bent and adequate surface rigidity not to damage the cartridge holder 20. The installation stopper 15 can be formed of a soft polyvinyl resin likewise the vent seal 14, an ABS (Acrylonitrile Butadiene Styrene) resin unlike the vent seal 14, PET (Polyethylene Terephthalate) resin, for example. These resins are comparatively inexpensive, and can desirably be affixed to the vent seal 14. The thickness of the installation stopper 15 can be set in a range between several 100 $\mu$m and several mm, and is preferable in a range between 2 mm and 5 mm, so that the installation stopper 15 does not easily change in form.

The ink supply section 16 is an opening having a concave shape, and closed with a non-illustrative supply section sealing film. When the ink cartridge 1 is entirely contained inside the cartridge holder 20, the ink supply section is engaged with an ink supply tube 2. When the ink cartridge 1 is in use, the ink supply tube 2 projects from a tube container 24, breaks through the supply section sealing film. Then, the ink supply tube 2 enters into the ink container 12 so as to be engaged with a packing member (not illustrated) prepared in the ink supply section 16.

The guide concave sections 17 are engaged with the tube container 24 included in the cartridge holder 20, and retains the ink cartridge 1 in a predetermined position. Because the ink supply section 16 and the tube container 24 are centered in the predetermined position, there is no need to set the position of the ink cartridge 1 in association with the position of the cartridge holder 20.

Figure 3:
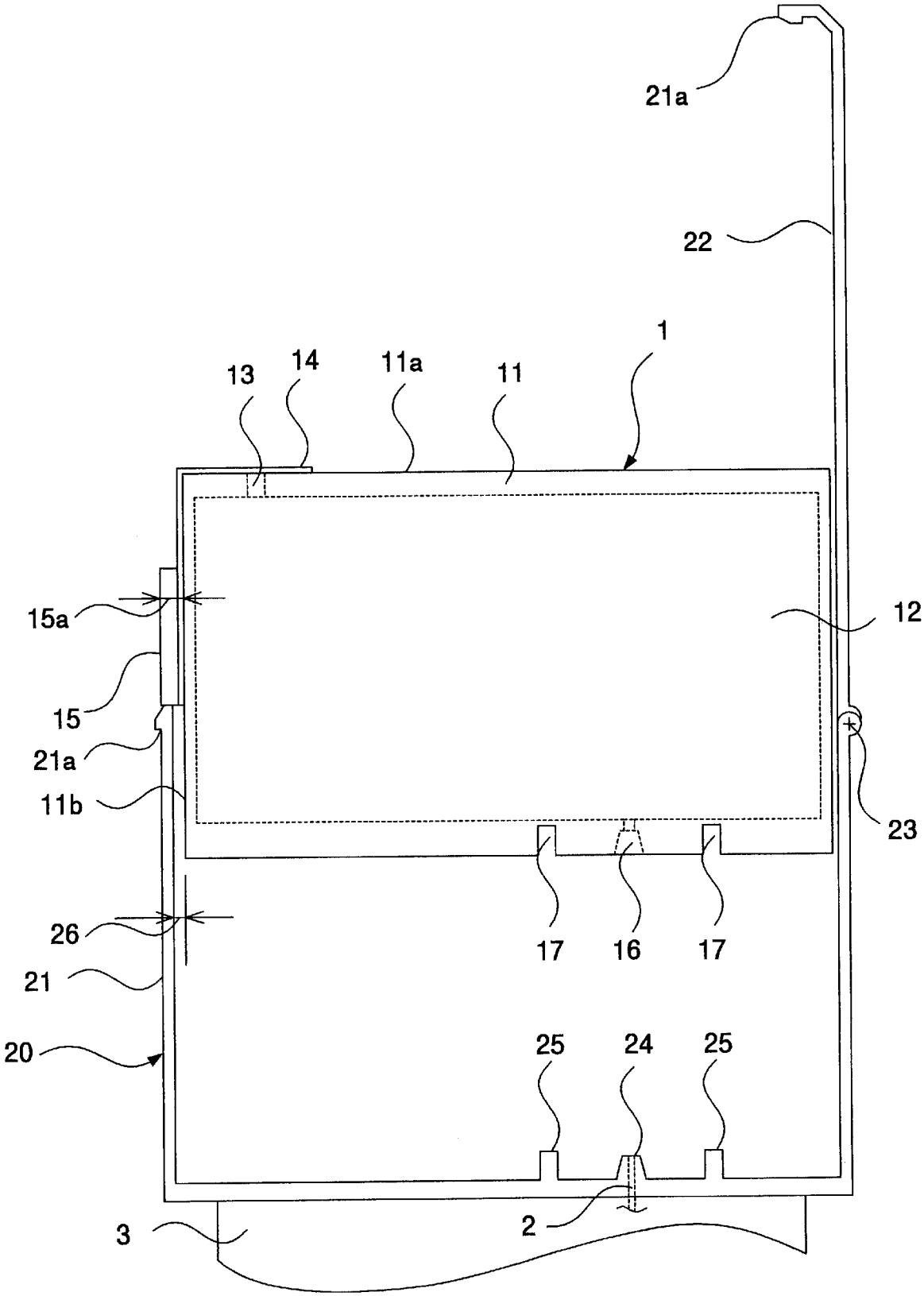
FIG. 3 is a cross sectional view of the ink cartridge which is inserted into a cartridge holder in a state where an installation stopper remains on the ink cartridge.
Figure 4:
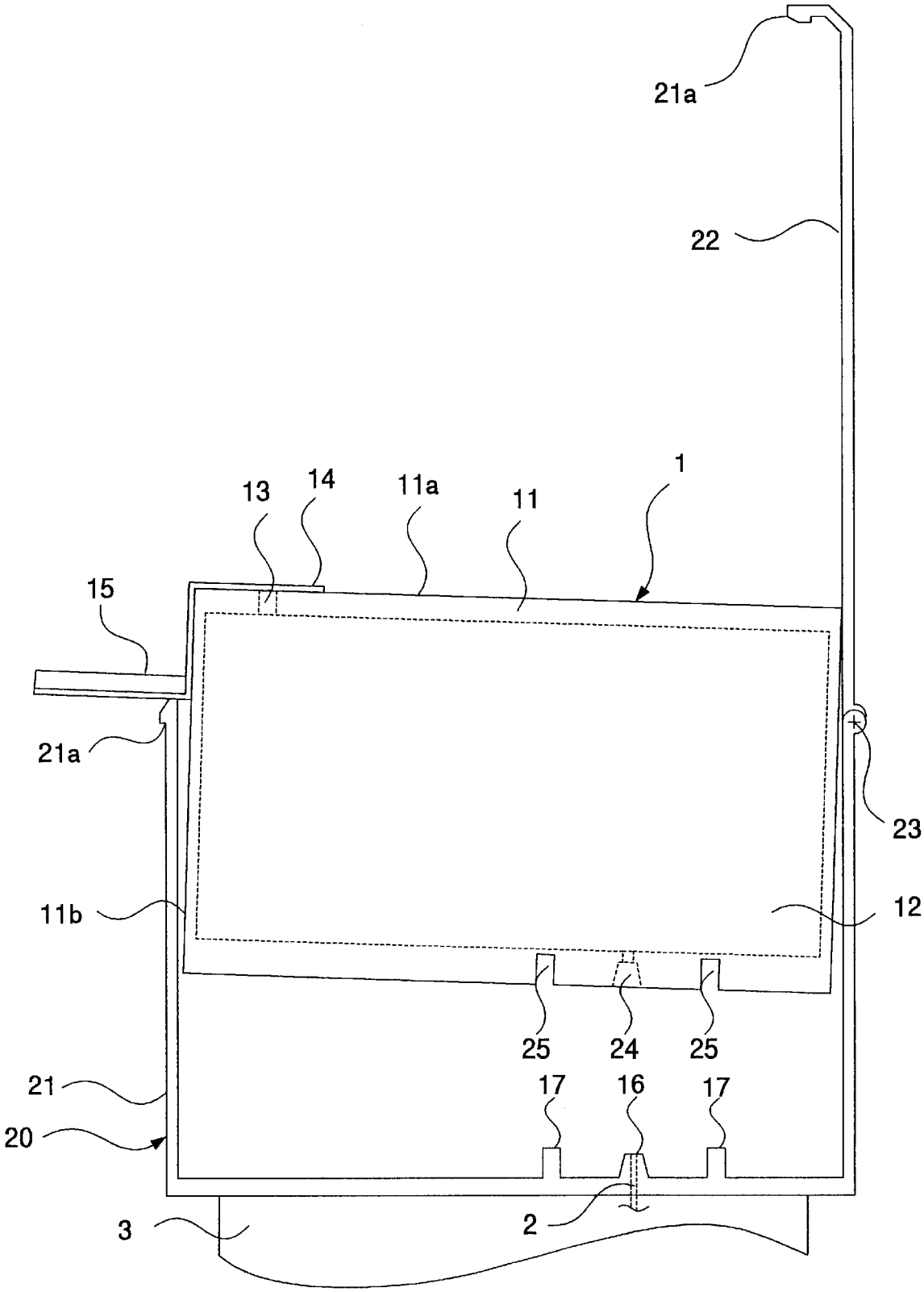
FIG. 4 is a cross sectional view of the ink cartridge which is inserted into the cartridge holder in another state where the installation stopper remains on the ink cartridge.
Figure 5:
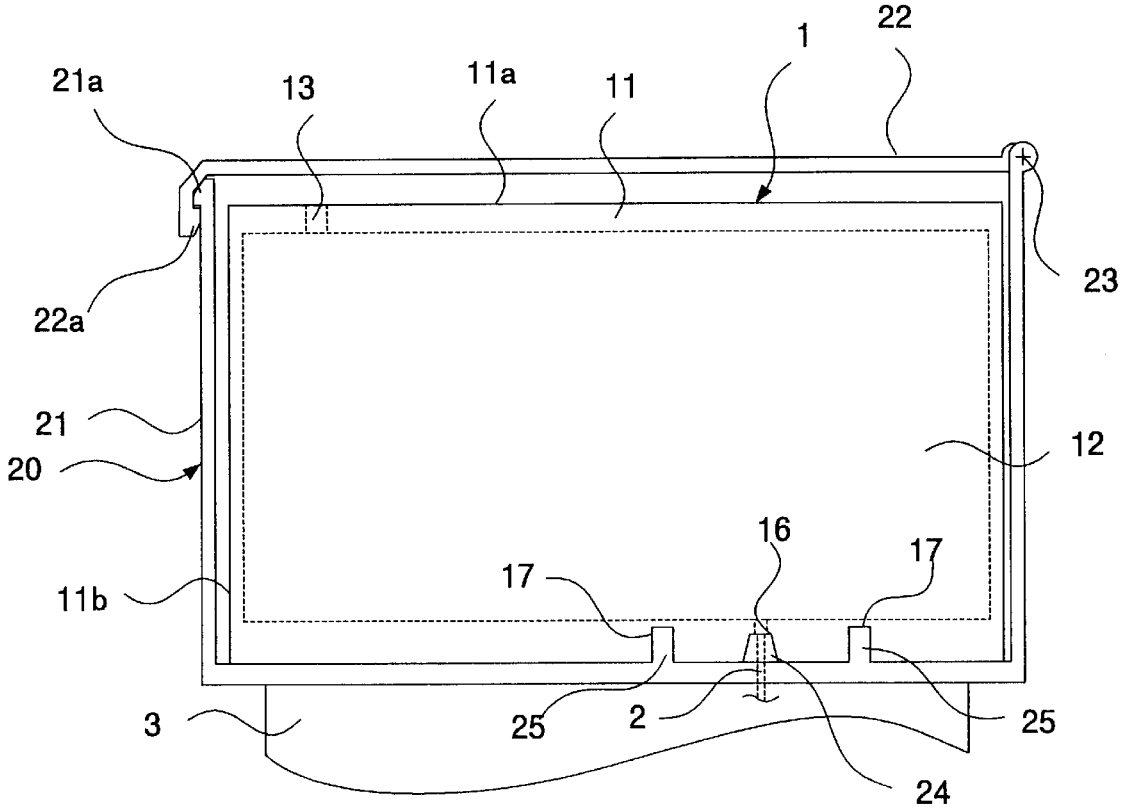
FIG. 5 is a cross sectional view of the ink cartridge which is inserted desirably into the cartridge holder in a state where the installation stopper is removed from the cartridge holder.

Explanations will now be made to an operation for installing the ink cartridge 1 according to this embodiment into the cartridge holder 20, with reference to the accompanying drawings FIGS. 3 to 5. FIGS. 3 and 4 both show the ink cartridge 1 which is installed into the cartridge holder 20 in a state where the vent seal 14 and the installation stopper 15 still remain on the cartridge 1. FIG. 5 shows the ink cartridge 1 which is appropriately installed into the cartridge holder 20 in a state where the vent seal 14 and the installation stopper 15 are removed from the ink cartridge 1.

As illustrated in FIG. 3, the cartridge holder 20 comprises a body 21, a lid section 22, a supporting shaft 23 which rotatively supports the lid section 22, the tube container 24 formed on the bottom surface of the body 21, and ribs 25 which are to be engaged with the guide concave section 17.

As shown in FIG. 5, if the ink cartridge 1 is appropriately installed into the cartridge holder 20, the cartridge holder 20 can contain the ink cartridge 1 entirely in a body 13. Thus, the lid section 22 rotates centrically about the supporting shaft 23. Then, an engagement hook 22*a* of the lid section 22 is engaged with an engagement claw 21*a* which is arranged in a position corresponding to the body 21, thereby to lock the lid section 22 and entirely contain the ink cartridge 1.

If the ink cartridge 1 is appropriately installed into the cartridge holder 20, the tube container 24 is engaged with the ink supply section 16 of the ink cartridge 1. When the recording head 3 is operated, the ink supply tube 2 projects from the tube container 24 and breaks through the supply section sealing film so as to enter the ink container 12. After this, the ink supply tube 2 is engaged with the packing member arranged in the ink supply section 16. Since the vent 13 of the ink cartridge 1 is open, the ink container 12 is exposed to the air, and the air pressure is added into the ink container 12. With this added air pressure, the ink supply tube 2 smoothly supply the recording head 3 with the ink contained in the ink container 12.

The ribs 25 which are formed on the bottom surface of the body 21 are engaged with the respective guide concave sections 17, so as to retain the ink cartridge 1 in a predetermined position. In this predetermined position, the tube container 24 and the ink supply section 16 are centered. Hence, the ink cartridge 1 can appropriately be installed into the cartridge holder 20.

As explained above, the thickness 15A including the thickness of the vent seal 14 and the thickness of the installation stopper 15 is equal to or larger than the size of the gap 26 between the side surface 11*b* and the internal surface of the body 21. In this structure, if the ink cartridge 1 is inserted into the cartridge holder 20 without removing the vent seal 14 from the ink cartridge 1, the installation stopper 15 is in contact with the engagement hook 21*a* in the upper section of the body 21.

As shown in FIG. 3, when the lower section of the installation stopper 15 reaches the engagement hook 21*a*, the ink cartridge 1 can not further be inserted into the cartridge holder 20. This lets a user know that the ink cartridge 1 has inappropriately be installed into the cartridge holder 20 without removing the vent seal 14.

As shown in FIG. 4, when the installation stopper 15 reaches the engagement hook 21*a* and projects from the body 21, the ink cartridge 1 stops in an inclined state. Hence, the ink cartridge 1 can not entirely be contained inside the cartridge holder 20. Therefore, the user can be aware that the ink cartridge 1 has inappropriately been inserted into the cartridge holder 20 without removing the vent seal 14. Even if the user operates a printer without knowing the inappropriate installation of the ink cartridge 1, the ink supply tube 2 can not enter the ink supply section 16, the tube 2 can not provide the recording head 3 with any ink, thus the recording head 3 can not output any ink. As a result of this, the user can surely be aware that the ink cartridge 1 has inappropriately been installed into the cartridge holder 20.

As explained above, if the ink cartridge 1 is inserted into the cartridge holder 20 without removing the vent seal 14 and the installation stopper 15 from the casing 11, the ink cartridge 1 can not entirely be contained in the cartridge holder 20, and partially sticks out from the cartridge holder 20. Because of the awkward form of the ink cartridge 1, the user can simply be aware of the inappropriate installation. In this case, the user simply tears out the installation stopper 15 together with the vent seal 14 from the ink cartridge 1, thereby to succeed in inserting the ink cartridge 1 into the cartridge holder 20, as shown in FIG. 5.

Even if the ink cartridge 1 is inserted into the cartridge holder 20 without removing the vent seal 14, i.e. without opening the vent 13, the ink supply tube 2 can not enter the ink container 12 nor provide the recording head 3 with ink. Thus, even if the user tries to operate a printer without knowing the inappropriate installation of the ink cartridge 1, the unstable outputting of ink as caused by the low level of pressure inside the ink container 12 does not occur, and poor printing is not performed, as may be caused by negative pressure thereinside, resulting in the air entering the ink container 12.

Figure 6:
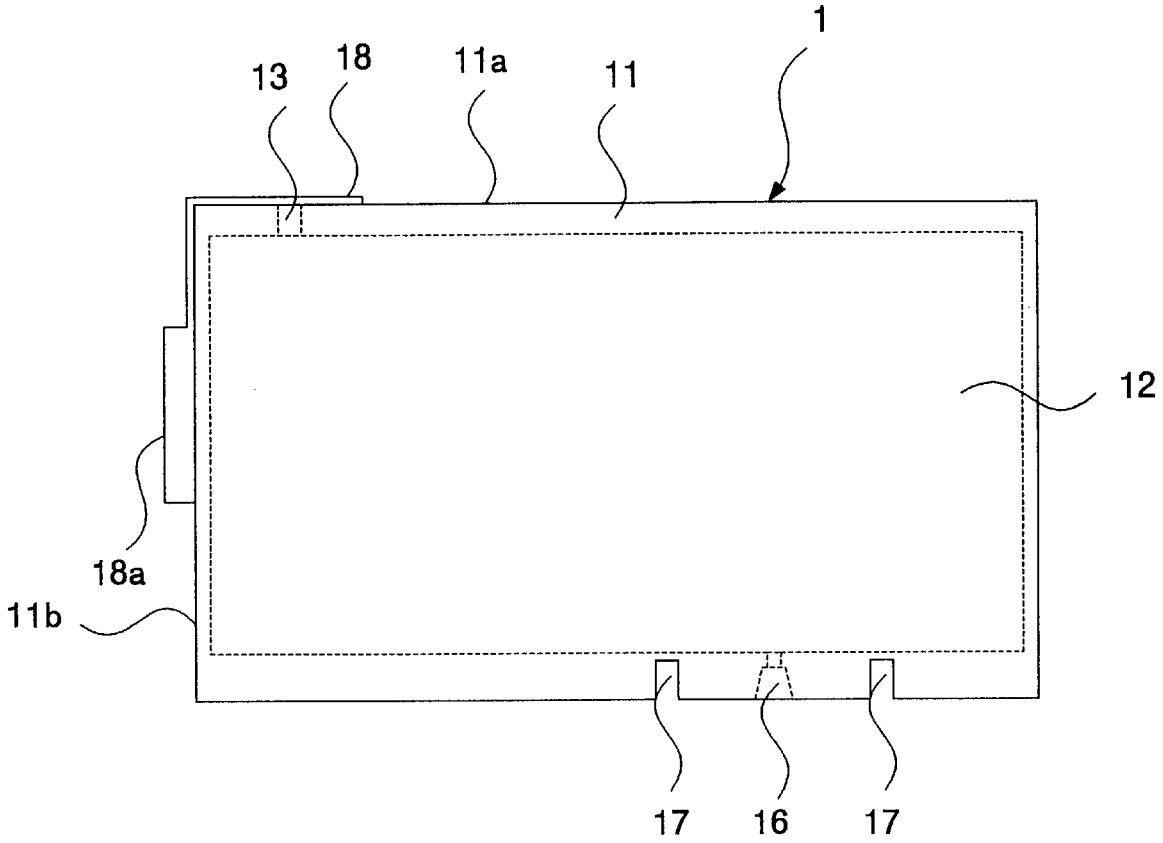
FIG. 6 is a cross sectional view showing the structure of a vent seal for use in the ink cartridge.
Figure 7:
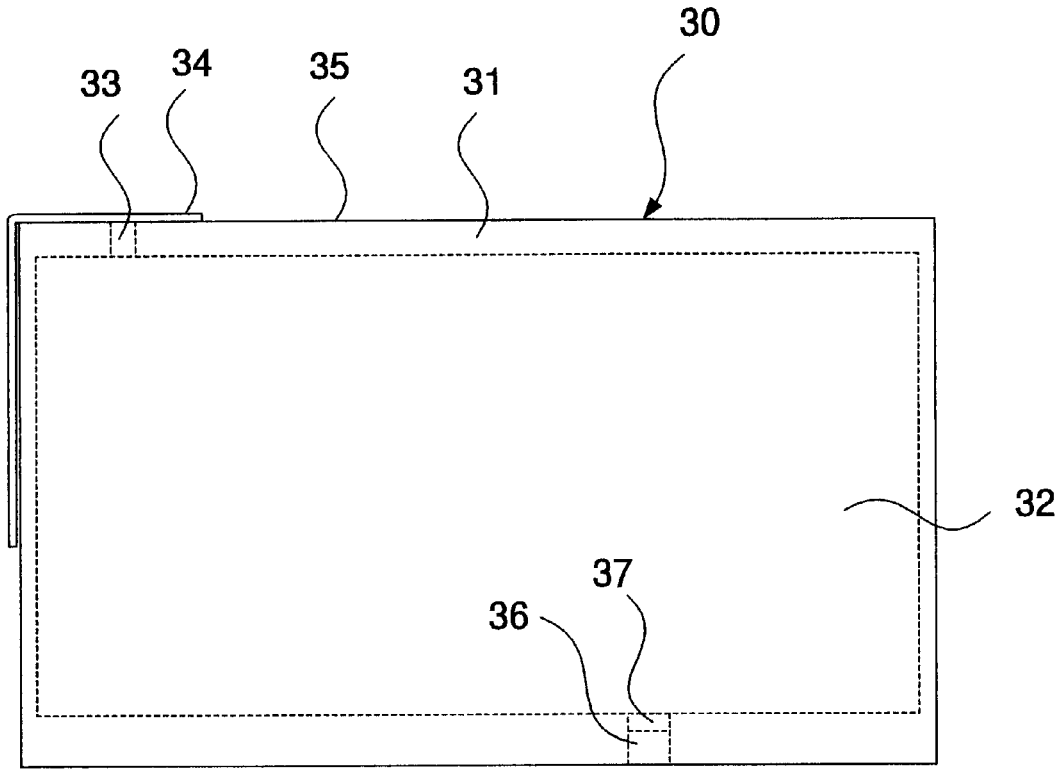
Fig.7 (PRIOR ART)
FIG. 7 is a side view showing a conventional ink cartridge for use in an ink jet printer.
Figure 8:
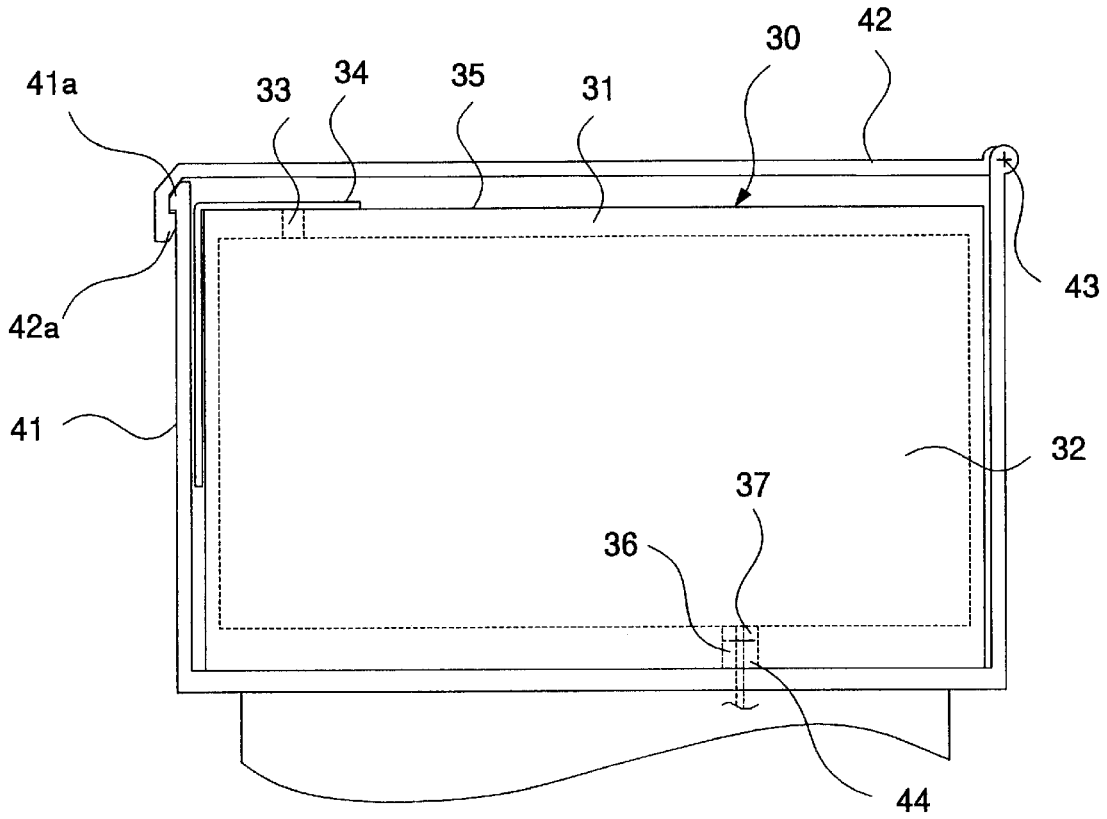
Fig.8 (PRIOR ART)
FIG. 8 is a cross sectional view showing the conventional ink cartridge which is contained in a cartridge holder.

Explanations will now be made to an example of another structure of the vent seal 14 for use in the ink cartridge 1 with reference to FIG. 6. In FIG. 6, the same reference numerals are given to the same component elements as those illustrated in FIG. 2.

As illustrated in FIG. 6, a vent seal 18 is formed entirely in a tape-like shape. One end of the vent seal 18 is affixed onto the upper surface 11*a* in a circumferential section of the vent 13, while the other end thereof includes an installation stopper 18*a*, which is formed of the same material as that of the vent seal 18 and formed in one unit with the vent seal 18. An adhesive is applied onto the back surface of the vent seal 18, whereby the vent seal 18 is affixed onto the casing along the upper surface 11*a* to the side surface 11*b*. No adhesive is applied onto the back surface of the other end of the installation stopper 18*a*. Hence, the installation stopper 18*a* has a function for preventing the ink cartridge 1 from being inappropriately installed into the cartridge holder 20 and a function as a seal-pull for pulling the vent seal 18, as described above.

The vent seal 18 is formed of such a material that the vent seal 18 can easily be bent along the upper surface 11*a* to the side surface 11*b*. The vent seal 14 can be formed of any material, as long as the material has adequate strength, such as a inexpensive flexible poly-vinyl material, etc. The thickness of the vent seal 14 is desirable in a range between 10 and several 100 $\mu$m. In this case, when detaching the vent seal 14 from the ink cartridge 1, it is likely to change in form and not to torn off. Therefore, the vent seal 14 can be removed from the casing 11 with ease.

The installation stopper 18*a* is formed in such a way that its thickness is equal to or larger the size of the gap 26 between the side surface 11*b* and the internal wall of the cartridge holder 20. The thickness of the installation stopper 18*a* can be set in a range between several 100 $\mu$m and several mm, and is preferable in a range between 2 mm and 5 mm, so that the installation stopper 15 does not easily change in form.

The vent seal 18 shown in FIG. 6 has the same effect as that of the vent seal 14 and the installation stopper 15 which are illustrated in FIG. 2. The vent seal 18 and the installation stopper 18*a* can be formed of the same material in the same manufacturing step. This results in a simplification of the manufacturing process for manufacturing the vent seal 18 including the installation stopper 18*a*.

Various embodiments and changes may be made thereonto without departing from the broad spirit and scope of the invention.

In the above embodiment, the installation stoppers 15 and 18*a* are formed in a rectangular shape, but can be formed in an arbitrary shape. For example, the installation stoppers 15 and 18*a* can be formed in a spherical shape or a ring-like shape, as long as they can not be fit into the gap between the side surface 11*b* and the internal wall of the cartridge holder 20.

In the above embodiment, the cartridge holder 20 has the lid section 22 which can rotate centrically about the supporting shaft 23. However, the cartridge holder 20 may only have the body 21 including the tube container 24 and the ribs 25 on the bottom surface thereof, and may have an upper section which is open, instead of the lid section 22. While the printer is operated, the cartridge holder 20 is slidable together with the recording head 3. During this movement, the structure of the cartridge holder 20 is satisfactory, if the appropriately-installed ink cartridge 1 is retained in a desired position and the tube container 24 and the ink supply section 16 are tightly engaged with each other so as not to be separated from each other.

In the above embodiment, the installation stoppers 15 and 18*a* are prepared on the side surface 11*b*. However, the installation stoppers 15 and 18*a* can be prepared on the bottom surface of the casing 11. Because of the thickness of the installation stoppers 15 and 18*a*, the guide concave sections 17 formed on the bottom surface of the casing 11 are not entirely engaged with the ribs 25 formed on the bottom surface of the cartridge holder 20. In this structure, the tube container 24 is not engaged with the ink supply section 16, thus the ink supply tube 2 does not enter the ink container 12, i.e. no ink is supplied onto the recording head 3. Hence, the user can be aware that the ink cartridge 1 has inappropriately been installed into the cartridge holder 20.

The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2000-073298 filed on Mar. 16, 2000, and including specification, claims, drawings and summary. The disclosure of the above Japanese Patent Application is incorporated herein by reference in its entirety.

What is claimed is:

1. An ink cartridge, which is contained in a cartridge container of a printer, comprising:

an ink container;

a vent which is provided in said ink container;

an ink supply hole for accepting an ink supply tube, being in contact with a recording head of the printer so as to supply an ink thereto;

an ink supply section which includes said ink supply hole and is engaged with a tube container, being formed in the cartridge container, containing the ink supply tube and having a recess shape;

a closing member for closing said vent, and which is removed from said ink cartridge before said ink cartridge is used; and an installation stopper which is formed in one unit with said closing member and prevents said ink supply tube from entering said ink supply hole, when said ink supply section is inserted into said cartridge container without removing said closing member.

2. The ink cartridge according to claim 1, wherein:

a recessed section is formed in a circumferential section of said ink supply section; and said recessed section is engaged with a rib which is formed in a circumferential section of said tube container, and is prepared so as to settle a position of said ink supply section, thereby said ink supply section and said tube container are centered.

3. The ink cartridge according to claim 1, wherein:

said installation stopper and said closing member are formed in a tape-like shape; and a thickness of said installation stopper is larger than a thickness of said closing member.

4. The ink cartridge according to claim 1, wherein:

said closing member is an adhesive tape onto whose back surface which an adhesive is affixed; and said installation stopper is adhered to an outer circumference of said ink container.

5. The ink cartridge according to claim 1, wherein:

said closing member is an adhesive tape onto whose back surface an adhesive is affixed; and said installation stopper droops down and is detached from an outer circumference of said ink container.

6. The ink cartridge according to claim 4, wherein said installation stopper is formed of a material which differs from a material of said closing member.

7. The ink cartridge according to claim 4, wherein said installation stopper is formed of a same material as a material of said closing member.

8. An ink jet printer comprising:

a recording head which outputs an ink onto a recording medium;

a cartridge container which contains an ink cartridge including a vent and a tube container having a recess shape;

an ink supply tube contained inside said tube container which contacts said recording head and supplies an ink thereonto;

a closing member for closing said vent; and an installation stopper formed in one unit together with said closing member, and wherein said tube container is engaged with an ink supply section of the ink cartridge, and said ink supply tube enters an ink supply hole included in said ink supply section so as to supply the recording head with an ink, when the ink cartridge, from which said installation stopper is removed, is inserted into the cartridge container.

9. The ink jet printer according to claim 8, wherein:

said cartridge container includes a rotatable lid section and a body including said tube container; and when the ink cartridge without the installation stopper is inserted into said cartridge container, the lid section rotates so as to be engaged with the body.

10. The ink jet printer according to claim 8, wherein said cartridge container includes a rib, which is engaged with a recessed section formed in a circumferential section of the ink cartridge, and which is prepared so as to settle a position of said ink supply section, thereby said tube container and said ink supply section are centered.

* * * * *